US008382112B2

(12) United States Patent
Sabeur

(10) Patent No.: US 8,382,112 B2
(45) Date of Patent: Feb. 26, 2013

(54) LOGIC GAME OF THE THREE-DIMENSIONAL BRAIN TEASER TYPE

(76) Inventor: Boujelben Sabeur, Weingarten (DE)

( * ) Notice: Subject to any disclaimer, the term of this patent is extended or adjusted under 35 U.S.C. 154(b) by 232 days.

(21) Appl. No.: 12/997,172

(22) PCT Filed: Jun. 9, 2009

(86) PCT No.: PCT/IB2009/006276

§ 371 (c)(1),
(2), (4) Date: Dec. 9, 2010

(87) PCT Pub. No.: WO2009/150542

PCT Pub. Date: Dec. 17, 2009

(65) Prior Publication Data

US 2011/0084445 A1 Apr. 14, 2011

(30) Foreign Application Priority Data

Jun. 12, 2008 (FR) ..... 08 03264

(51) Int. Cl.
*A63F 9/08* (2006.01)

(52) U.S. Cl. ..... 273/153 S; 273/157 R

(58) Field of Classification Search ..... 273/153 S, 273/156, 157 R

See application file for complete search history.

(56) References Cited

U.S. PATENT DOCUMENTS 4,949,969 A * 8/1990 Johnson ..... 273/153 S
4,983,062 A * 1/1991 Hour ..... 273/153 S
5,074,561 A * 12/1991 Johnson ..... 273/153 S
5,083,788 A * 1/1992 Conotter ..... 273/153 S
5,116,053 A * 5/1992 Blankenburg et al. ..... 273/153 S
5,429,364 A * 7/1995 Chang ..... 273/153 S
5,845,904 A * 12/1998 Hawkins ..... 273/153 S
7,275,744 B1 * 10/2007 Kuo et al. ..... 273/153 S
7,311,306 B2 * 12/2007 Chuang ..... 273/153 S
8,251,366 B1 * 8/2012 Nathan et al. ..... 273/153 S
2003/0155709 A1 * 8/2003 Han ..... 273/153 S (Continued)

FOREIGN PATENT DOCUMENTS

WO 2004039465 A1 5/2004

OTHER PUBLICATIONS

Written Opinion for First Filed Application, French Application No. FR0803264.

(Continued)

*Primary Examiner* — Steven Wong

(74) *Attorney, Agent, or Firm* — Altman & Martin; Steven K Martin

(57) ABSTRACT

Three-dimensional logic game comprising a solid body (1) that has an axis of symmetry (A), on the surface of which body there are arranged rails (3) that are parallel to said axis, tiles (2) being slidably mounted on said rails, and said solid body being made up of a plurality of segments (1*a*-1*e*) that can revolve about said axis so as to allow the positions of the corresponding rail segments to be switched around. A logic game such as this is characterized in that at least one segment (30) of one rail is created on one face of a rotary piece (15), a rotation of which allows the rail segment (30) to be removed from the surface of the solid body by bringing it into a retracted position with the tiles associated with it, and allows an identical rail segment (30') previously located in said retracted position to be brought onto said surface. Thus, an empty space (25) is formed on the rail to allow the corresponding tiles to be moved.

20 Claims, 1 Drawing Sheet

U.S. PATENT DOCUMENTS

2003/0227131 A1* 12/2003 Han ..... 273/153 S
2004/0046318 A1* 3/2004 Christensen ..... 273/153 S
2006/0061033 A1* 3/2006 Han ..... 273/153 S
2006/0175752 A1* 8/2006 Chuang ..... 273/153 S
2010/0213669 A1* 8/2010 Kim et al. ..... 273/153 S
2011/0057387 A1* 3/2011 Yang ..... 273/153 S

OTHER PUBLICATIONS

International Search Report and Written Opinion for PCT Application No. PCT/IB2009/06276 from which priority is claimed.

* cited by examiner

LOGIC GAME OF THE THREE-DIMENSIONAL BRAIN TEASER TYPE

The invention relates to a logic game of the three-dimensional brain teaser type, belonging to the displacement-type brain teaser family.

Displacement-type brain teasers are logic games in which the aim is to move a piece from one position to another, or to arrange a plurality of pieces in a given order, while respecting certain constraints. Most of these games involve displacements by translation in one plane.

The most famous of these games, of the two-dimensional type, is the "15 puzzle". This game consists of a square frame containing 15 small squares of identical dimensions, numbered from 1 to 15, as well as an empty location having the dimensions of one square. The squares can slide inside the frame due to the presence of said empty location. The game consists of placing the squares in order starting from any initial configuration.

As a variant, the squares are not numbered, but an image is created on the upper surface thereof. The image is scrambled when the squares are not in order, the aim of the game being to reconstruct the image.

The game known by the name of "Klotski" can be considered to be a variant of the 15 puzzle. It consists of a rectangular frame in which square or rectangular tiles are placed, these tiles being able to be displaced by sliding, as well as an empty location. The largest of these tiles has a square shape and is painted red (or identified in some other way). At the start, it is at one end of the frame; the aim of the game is to determine a sequence of movements making it possible to move this piece to the opposite end of said frame.

Other logic games are three-dimensional. Among these games, the most famous is probably the "Rubik's cube".

This game consists of a cube, each face of which is divided into nine (3×3) cubic elements which can rotate independently of the others. In fact the cube consists only of 26, and not 27, cubic elements, the central element consisting of a set of axes carrying the central elements of the 6 faces. The visible faces of each cubic element are colored so that, in the solved state of the game, each face of the cube has a homogeneous coloring. The independent rotation of each face makes it possible to mix the cubic elements; the game consists of manipulating the cube in order to reinstate its original appearance, with the six self-colored faces.

The "Rubik's cube" also exists in differently shaped versions: tetrahedron, octahedron, dodecahedron, icosahedron, sphere. In all cases, it necessarily involves simple and regular shapes.

The invention relates to a logic game of the three-dimensional type which can be produced in an infinite number of different shapes, which makes it possible to give it a decorative value as well as an entertainment value. Logic games of this type are disclosed for example by the documents US 2006/061033, WO 2004/039465 and U.S. Pat. No. 7,275,744.

The invention aims to improve such games by using technical means which make it possible to improve the esthetic appearance thereof and/or to increase the complexity thereof.

A logic game of the three-dimensional brain teaser type according to the invention essentially consists of a solid body having an axis of symmetry, in which: a plurality of rails, having an orientation substantially parallel to said axis of symmetry, are uniformly distributed on an outer surface of said solid body; tiles are slidably mounted on said rails, said tiles having decorative elements which make it possible to assign to each tile a given position, and at least one empty location being provided on at least one rail so as to allow the displacement of the corresponding tiles; and said solid body consists of a plurality of segments which can rotate about said axis of symmetry, so as to make it possible to switch the positions of the corresponding rail segments. Such a logic game is characterized in that at least one segment of one of said rails is created on one face of a rotating piece, a rotation of said piece making it possible: to remove said rail segment from said outer surface of the solid body by moving it into a hidden position together with the tiles associated therewith; and to move onto said outer surface an identical rail segment which was previously in said hidden position; by means of which an empty location is formed on said rail so as to allow the displacement of the corresponding tiles.

According to particular embodiments of the invention:

- The segments of said solid body may have longitudinal dimensions which are adapted so that the corresponding rail segments can carry one or more of said tiles.
- Said solid body may comprise a plurality of faces separated by edges, said rails being arranged in correspondence with said edges. In this case, said tiles may have a generally dihedral shape.
- Said rails and said tiles may be shaped in such a way that each tile can be moved from a first locked position to a second position which allows the sliding thereof on said rail, and vice versa. In particular, each tile may be moved from said first to said second locked position and vice versa by the application of a force oriented perpendicular to said rail.
- At least some of said decorative elements making it possible to assign to each tile a given position on the surface of said solid body are elements in relief. In this case, the game in its entirety, consisting of the solid body and of the tiles, may not exhibit rotational symmetry.
- Said rails may be created by machining the surface of said solid body.

Other features, details and advantages of the invention will become apparent from reading the description made with reference to the appended drawings which are given by way of example and in which:

FIG. 1 shows a logic game according to the invention which is in the form of a miniature reproduction of the "Eiffel Tower". This shape is particularly suitable for serving as a base for such a game, since it exhibits (4th-order) rotational symmetry about an axis of symmetry A.

Figure 1:
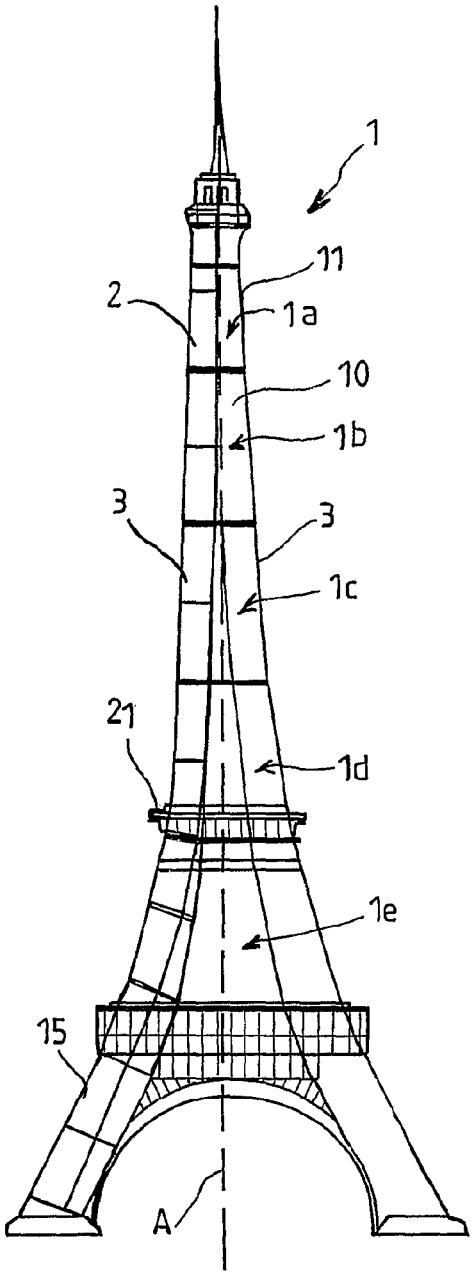
FIG. 1 shows an overall view of a game according to one embodiment of the invention.

The solid body 1 in the shape of the Eiffel Tower which constitutes the basic element of the game is subdivided into five segments (this number is given only by way of example) 1*a*-1*e* which are mounted so as to be able to rotate about the axis A. Since said solid body 1 exhibits 4th-order rotational symmetry, a 90° rotation of one of the segments leaves the structure substantially unchanged.

The body 1 has an outer surface consisting of four main faces 10 separated by four edges 11. Rails 3, oriented substantially parallel to the axis of rotation A, are provided in the vicinity of said edges. Under these conditions, the rotation of a segment 1*a*-1*e* about the axis A switches the positions of the corresponding rail segments.

The function of the rails 3 is to retain the tiles 2, having a generally dihedral shape, while allowing the sliding thereof. In order not to overload FIG. 1, tiles have been shown on just one edge of the solid body 1; in reality, tiles will normally be provided on the four edges.

Figure 2:
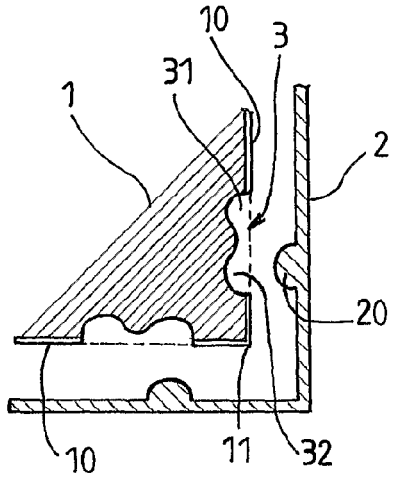
FIG. 2 shows a detail view of a rail arranged in the area of an edge of the solid body of the game of FIG. 1, and of the corresponding tile.

As shown in detail in FIG. 2, these rails consist of channels 31, 32 machined on the surface of the body 1. More precisely, FIG. 2 shows that each rail consists of two channels, arranged one on each side of the edge 11. Each channel consists of two adjacent grooves 31, 32 having the same cross section; the groove 31, further away from the edge, is discontinuous, while the groove 32 is continuous. The two inner faces of each dihedral tile carry two lugs 20 which mate with the shape of a groove. A tile can be engaged by pressing onto the edge 11 of the body 1, the two lugs 20 penetrating into the corresponding grooves 31. Since the latter are discontinuous, the tile cannot slide and remains locked in its position. By applying a traction force, it is possible to pull the tile 2 slightly (approx. 1 mm) away from the edge 11: the lugs thus exit from the grooves 31 in order to penetrate into the adjacent grooves 32 which, being continuous, allow the sliding of the tile. This presupposes that the tile has a certain elasticity.

Reciprocally, the application of a pressure makes it possible to lock the tile 2 again.

In order to allow the sliding of the tiles 2, the rails 3 (and therefore the edges of the solid body 1) must be straight, or at least have at any point a large radius of curvature relative to the longitudinal dimensions of the tiles. However, the Eiffel Tower has protruding elements, particularly at the different levels (see FIG. 1). The solid body 1 therefore constitutes a "smoothed" version of this monument. The protruding elements, on the other hand, can be created on the outer surface of the tiles 2: see reference 21 in FIG. 1.

The different tiles all have the same longitudinal dimensions, and more precisely the length thereof is an exact submultiple of the length of the segments 1*a*-1*e* (or, more precisely, of the rail segments associated therewith). In this way, the presence of said tiles does not prevent the rotation of said segments. This condition does not have to be met if the tiles are not arranged side by side but rather are separated by an empty space; in this case, all that is required is that the longitudinal dimensions of each segment are sufficient to allow it to carry one or more tiles.

It is assumed that the rails 3 arranged on the four edges 11 of the body 1 carry the maximum admissible number of tiles, apart from one. In other words, one of said rails has an empty location.

This empty location allows a one-dimensional movement of the tiles attached to said rail. In addition, the rotation of the segments 1*a*-1*e* makes it possible for groups of tiles to pass from one rail to the other. These two movements combined make it possible to switch the positions of the tiles 2, as is the case with the squares of a 15 puzzle, but in a more complex manner and on a non-planar surface.

The outer surfaces of the tiles have decorative elements which make it possible to assign to each tile a given location on the surface of the solid body 1. These decorative elements may be two-dimensional (printed motifs) or three-dimensional (protruding elements 21). The use of one-dimensional decorative elements is of particular interest since it makes it possible to make the shape of the game as a whole asymmetric, even if the solid body 1 must necessary exhibit rotational symmetry so as to allow the "switching" of the rail segments by pivoting the segments 1*a*-1*e* about the axis A.

The game consists of mixing the tiles 2 by sliding movements along the rails and by rotational movements of the segments 1*a*-1*e*, and then reconstructing the original configuration.

However, the presence of an empty location is esthetically rather unpleasing. For this reason, the invention provides a means which makes it possible to remove temporarily one or more tiles from the outer surface of the game.

Figure 3A:
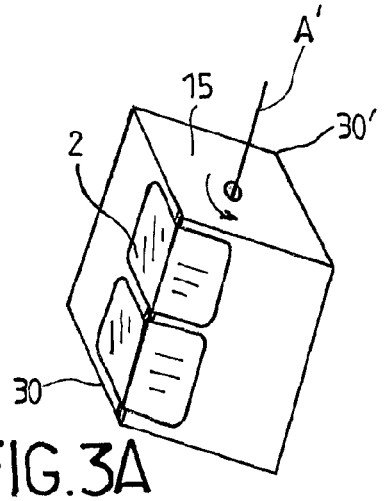
FIGS. 3A and 3B show a mechanism making it possible to form provisionally an empty location on a rail so as to allow the displacement of the corresponding tiles.
Figure 3B:
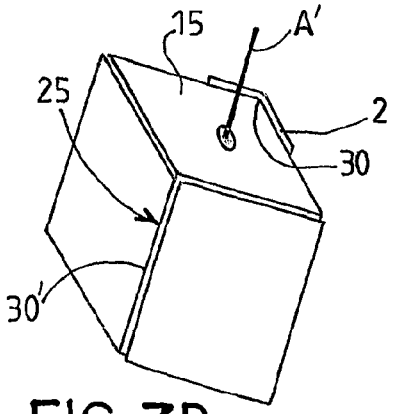

According to this embodiment, a rail segment 30 is created on an edge (or, as a variant, on a face) of a piece 15 which can rotate about an axis A'. A 180° rotation of the piece 15 moves the rail segment 30, and the tile(s) carried by the latter, into a hidden position, for example hidden inside the solid body 1. Furthermore, this rotation exposes another rail segment 30' by moving it onto the surface of said solid body, this rail segment being substantially identical but not carrying any tiles. In this way, an empty location on the rail 3 in question is provisionally created. Once all the tiles have been put back in place, the piece 15 is again rotated so as to once again expose the tiles that had been hidden. FIGS. 3A and 3B show the rotational movement of said piece 15: FIG. 3A corresponds to the initial position, in which the rail segment 30 carrying the tiles is exposed on the surface of the body 1; FIG. 3B corresponds to the hidden position of said segment.

In the example of FIG. 1, the rotating piece is arranged in the area of one of the four bottom "legs" of the miniature Eiffel Tower. It would also be possible to imagine having several of these pieces (for example four, one per leg).

As a variant or in addition, several faces or edges of the "legs" of the miniature Eiffel Tower may carry tiles. In this case, the rotation about the axis A' serves not, or not only, to temporarily free up a location, but rather makes it possible to switch said faces or edges carrying tiles. This variant makes it possible to make the game much more complicated.

The invention has been described with reference to one particular embodiment, and in particular to one particular shape (the Eiffel Tower); however, this is not in any way a limitation. Other shapes, in particular inspired by famous buildings or monuments, can be envisaged. As explained above, the use of tiles having decorative elements in relief makes it possible partially to circumvent the constraint linked to the rotational symmetry of the solid body 1.

Furthermore, the presence of edges is not essential. A game according to the invention could comprise a solid base body in the shape of a cylinder, with rails oriented vertically and arranged at regular intervals along its lateral surface.

The invention claimed is:

1. A logic game of the three-dimensional brain teaser type comprised a solid body (1) having an axis of symmetry (A), in which:

a plurality of rails (3), having an orientation substantially parallel to said axis of symmetry, are uniformly distributed on an outer surface of said solid body;

tiles (2) are slidably mounted on said rails, said tiles having decorative elements (21) which make it possible to assign to each tile a given position, and at least one empty location (25) being provided on at least one rail so as to allow the displacement of the corresponding tiles; and said solid body consists of a plurality of segments (1*a*-1*e*) which can rotate about said axis of symmetry, so as to make it possible to switch the positions of the corresponding rail segments;

said logic game being characterized in that at least one segment (30) of one of said rails is created on one face of a rotating piece (15), a rotation of said piece making it possible:

to remove said rail segment (30) from said outer surface of the solid body by moving it into a hidden position together with the tiles associated therewith; and to move onto said outer surface an identical rail segment (30') which was previously in said hidden position;

by means of which an empty location (25) is formed on said rail so as to allow the displacement of the corresponding tiles.

2. The logic game according to claim 1, in which the segments of said solid body have longitudinal dimensions which are adapted so that the corresponding rail segments can carry one or more of said tiles.

3. The logic game according to claim 2, in which said solid body comprises a plurality of faces (10) separated by edges (11), said rails (3) being arranged in correspondence with said edges.

4. The logic game according to claim 3, in which said tiles (2) have a generally dihedral shape.

5. The logic game according to claim 4, in which said rails and said tiles are shaped in such a way that each tile can be moved from a first locked position to a second position which allows the sliding thereof on said rail, and vice versa.

6. The logic game according to claim 5, in which each tile can be moved from said first to said second locked position and vice versa by the application of a force oriented perpendicular to said rail.

7. The logic game according to claim 1, in which said solid body comprises a plurality of faces (10) separated by edges (11), said rails (3) being arranged in correspondence with said edges.

8. The logic game according to claim 7, in which said rails and said tiles are shaped in such a way that each tile can be moved from a first locked position to a second position which allows the sliding thereof on said rail, and vice versa.

9. The logic game according to claim 7, in which each tile can be moved from said first to said second locked position and vice versa by the application of a force oriented perpendicular to said rail.

10. The logic game according to claim 7, in which said tiles (2) have a generally dihedral shape.

11. The logic game according to claim 10, in which said rails and said tiles are shaped in such a way that each tile can be moved from a first locked position to a second position which allows the sliding thereof on said rail, and vice versa.

12. The logic game according to claim 11, in which each tile can be moved from said first to said second locked position and vice versa by the application of a force oriented perpendicular to said rail.

13. The logic game according to claim 3, in which said rails and said tiles are shaped in such a way that each tile can be moved from a first locked position to a second position which allows the sliding thereof on said rail, and vice versa.

14. The logic game according to claim 13, in which each tile can be moved from said first to said second locked position and vice versa by the application of a force oriented perpendicular to said rail.

15. The logic game according to claim 2, in which said rails and said tiles are shaped in such a way that each tile can be moved from a first locked position to a second position which allows the sliding thereof on said rail, and vice versa.

16. The logic game according to claim 15, in which each tile can be moved from said first to said second locked position and vice versa by the application of a force oriented perpendicular to said rail.

17. The logic game according to claim 1, in which said rails and said tiles are shaped in such a way that each tile can be moved from a first locked position to a second position which allows the sliding thereof on said rail, and vice versa.

18. The logic game according to claim 17, in which each tile can be moved from said first to said second locked position and vice versa by the application of a force oriented perpendicular to said rail.

19. The logic game according to claim 1, in which at least some of said decorative elements (21) making it possible to assign to each tile a given position on the surface of said solid body are elements in relief.

20. The logic game according to claim 1, in which said rails (3) are created by machining the surface of said solid body.

* * * * *